US011174618B2

(12) United States Patent
Currier

(10) Patent No.: US 11,174,618 B2
(45) Date of Patent: Nov. 16, 2021

(54) SYSTEM AND METHOD FOR AUTOMATED PAYLOAD TARGET TIPOFF

(71) Applicant: Caterpillar Inc., Deerfield, IL (US)

(72) Inventor: Shaun Currier, Naperville, IL (US)

(73) Assignee: Caterpillar Inc., Peoria, IL (US)

( * ) Notice: Subject to any disclaimer, the term of this patent is extended or adjusted under 35 U.S.C. 154(b) by 379 days.

(21) Appl. No.: 16/280,442

(22) Filed: Feb. 20, 2019

(65) Prior Publication Data

US 2020/0263384 A1 Aug. 20, 2020

(51) Int. Cl.

| | |
|---|---|
| ***E02F 3/43*** | (2006.01) |
| ***E02F 9/20*** | (2006.01) |
| ***E02F 3/28*** | (2006.01) |

(52) U.S. Cl.

CPC ..... *E02F 3/434* (2013.01); *E02F 3/283* (2013.01); *E02F 9/2025* (2013.01)

(58) Field of Classification Search

CPC ..... E02F 3/434; E02F 3/283; E02F 9/2025; E02F 9/264; E02F 9/0841

See application file for complete search history.

(56) References Cited

U.S. PATENT DOCUMENTS 6,858,809 B2 * 2/2005 Bender ..... G01G 19/12 177/136
6,879,899 B2 * 4/2005 Budde ..... E02F 3/432 172/2
6,931,772 B2 * 8/2005 Furuno ..... G01G 19/08 37/348
7,276,669 B2 * 10/2007 Dahl ..... G01G 19/083 177/136
7,627,410 B2 * 12/2009 Berry ..... E02F 9/2029 701/1
7,797,860 B2 * 9/2010 Schoenmaker ..... E02F 3/439 37/348
8,156,048 B2 * 4/2012 Mintah ..... E02F 9/264 705/50
8,271,229 B2 * 9/2012 Hsu ..... E02F 9/264 702/174

(Continued)

OTHER PUBLICATIONS

Flint Equipment Company, "L-Series Wheel Loaders", YouTube Video, Jan. 23, 2019, https://www.youtube.com/watch?v=UXGIgXQLy9w&feature=youtu.be.

*Primary Examiner* — Luis A Martinez Borrero

(57) ABSTRACT

A payload detection system for automated payload tip-off of a loading operation includes a tip-off controller. The tip-off controller is configured to receive a signal of a remaining payload target; receive a signal of a material weight within an implement and a signal of an angle of the implement; and determine a tip-off threshold based on the material weight and the remaining payload target. The tipoff controller initiates a bulk dump sequence if a difference between the material weight and the remaining payload target is greater than the tip-off threshold and initiates a slow dump sequence if the difference is below the tip-off threshold. The bulk dump sequence includes a single implement actuation to induce material spill until the tip-off threshold is met and the material is staged. The slow dump sequence includes a plurality of dump then rack actuations to induce and then prevent material spill until the remaining payload target is met, each dump actuation having an associated dump angle and each successive dump angle is progressively smaller.

20 Claims, 9 Drawing Sheets

(56) References Cited

U.S. PATENT DOCUMENTS 8,428,832 B2 * 4/2013 Marathe ..... E02F 9/264 701/50
8,903,689 B2 * 12/2014 Dunbabin ..... E02F 9/265 703/6
8,954,243 B2 * 2/2015 Harshberger ..... G01G 19/10 701/50
8,977,445 B2 * 3/2015 Buettner ..... E02F 9/264 701/50
9,157,215 B2 * 10/2015 Stanley ..... E02F 9/264
9,221,659 B2 12/2015 Fukasu et al.
9,508,053 B2 * 11/2016 Collins ..... G06Q 10/083
9,587,369 B2 * 3/2017 Fletcher ..... E02F 9/2029
9,695,571 B1 * 7/2017 Ge ..... G01G 19/08
9,850,639 B2 12/2017 Fletcher et al.
9,938,692 B2 * 4/2018 Shatters ..... E02F 9/26
10,801,177 B2 * 10/2020 Ready-Campbell ..... G05D 1/0219
10,968,598 B2 * 4/2021 Hashimoto ..... E02F 3/844
10,982,408 B2 * 4/2021 Ready-Campbell .... G06T 17/05
2005/0000703 A1 * 1/2005 Furuno ..... G01G 19/10 172/2
2006/0070773 A1 * 4/2006 Dahl ..... E02F 9/265 177/136
2007/0135985 A1 * 6/2007 Berry ..... E02F 9/2029 701/50
2007/0260380 A1 * 11/2007 Mintah ..... E02F 9/264 701/50
2014/0167971 A1 * 6/2014 Stanley ..... G01G 19/083 340/666
2014/0336874 A1 * 11/2014 Harshberger, II ..... G01G 19/10 701/36
2014/0371994 A1 * 12/2014 Buettner ..... E02F 9/26 701/50
2017/0191245 A1 * 7/2017 Shatters ..... E02F 3/283
2018/0179732 A1 * 6/2018 Bartsch ..... E02F 9/262
2020/0018037 A1 * 1/2020 Nakamura ..... G01G 19/18

* cited by examiner

SYSTEM AND METHOD FOR AUTOMATED PAYLOAD TARGET TIPOFF

TECHNICAL FIELD

The present disclosure generally relates worksite machine payload tipoff and, more particularly, to a method and system for automated payload target tipoff.

BACKGROUND

At worksites, such as excavation, surface mines, construction, and agricultural sites, worksite loading machines such as wheeled loaders, track-type loaders, backhoe loaders, and the like are relied upon to load loose payload material into haul vehicles such as over the road haul trucks. It is essential that the haul truck is sufficiently loaded to maximum capacity avoiding underloading or overloading situations which can be undesirable from a productivity and efficiency standpoint.

Typically, loaders have a payload control system which can accurately measure the payload in the bucket. Once activated, the payload control system can sum successive bucket payloads to determine an estimated amount of payload already deposited into the haul truck. During the final pass, the operator adjusts the final amount of payload in the implement to be dumped at the pile or dumps only a partial amount from the bucket directly into the haul truck. The process is referred to as tip-off or tipping-off. The former situation is known as pile tip-off where in-vehicle sensors determine the load in the bucket and operator tips-off excess payload onto the pile. The latter situation is known as truck tip-off where the operator racks the bucket and partially empties the bucket into the haul truck until the target payload capacity is reached.

While one strategy exists in co-owned U.S. Pat. No. 6,211,471 in which a Dump-to-Angle scheme is described. In practice, the operator must know the type of material as well as set the tip-off type manually. While the scheme appears to have promise, the weight signal from the in-vehicle sensors is a noisy signal due to linkage bounce and material settling. This requires extra time and attention from the operator which can detract from the ability to accomplish the tasks on a reliable and repeatable basis.

The disclosed method and system for automated payload target tip-off for loading a haul vehicle is directed to overcoming one or more of the problems set forth above.

SUMMARY OF THE DISCLOSURE

In accordance with one aspect of the disclosure, a method for automated payload tip-off for a worksite loading machine is presented. The method includes receiving a signal of a remaining payload target; loading material into an implement in excess of the remaining payload target; and receiving a signal of a material weight within the implement and a signal of an angle of the implement. A tip-off threshold is determined based on the material weight and the remaining payload target, wherein a difference between the material weight and the remaining payload target greater than the tip-off threshold triggers a bulk dump sequence, and the difference below the tip-off threshold triggers a slow dump sequence. The bulk dump sequence including a single implement actuation to induce material spill until the tip-off threshold is met and the material is staged. The slow dump sequence including a plurality of dump then rack actuations to induce and then prevent material spill until the remaining payload target is met, each dump actuation having an associated dump angle and each successive dump angle is progressively smaller.

In accordance with another aspect of the disclosure, a payload detection system for automated payload tip-off of a loading operation is presented. The system includes a tip-off controller configured to receive a signal of a remaining payload target and receive a signal of a material weight within an implement and a signal of an angle of the implement. A tip-off threshold is determined based on the material weight and the remaining payload target. A difference between the material weight and the remaining payload target greater than the tip-off threshold triggers a bulk dump sequence, and the difference below the tip-off threshold triggers a slow dump sequence. The bulk dump sequence includes a single implement actuation to induce material spill until the tip-off threshold is met and the material is staged. The slow dump sequence includes a plurality of dump then rack actuations to induce and then prevent material spill until the remaining payload target is met, each dump actuation having an associated dump angle and each successive dump angle is progressively smaller.

In accordance with a further aspect of the disclosure, a haul machine is presented. The haul machine includes an implement configured to hold a payload therein, a payload detection unit having at least one sensor for generating a signal of a material weight within the implement and at least one sensor for generating a signal of an angle of the implement, a a display unit for displaying a user interface including at least one of operator-selectable graphical element configured to initiate an automated tip-off operation, and a tip-off controller. The tip-off controller is configured to receive a signal of a remaining payload target, receive a signal of a material weight within the implement and a signal of an angle of the implement, and determine a tip-off threshold based on the material weight and the remaining payload target; wherein a difference between the material weight and the remaining payload target greater than the tip-off threshold triggers a bulk dump sequence, and the difference below the tip-off threshold triggers a slow dump sequence. The bulk dump sequence includes a single implement actuation to induce material spill until the tip-off threshold is met and the material is staged. The slow dump sequence including a plurality of dump then rack actuations to induce and then prevent material spill until the remaining payload target is met, each dump actuation having an associated dump angle and each successive dump angle is progressively smaller.

DETAILED DESCRIPTION

Aspects of the disclosure will now be described in detail with reference to the drawings, wherein like reference numbers refer to like elements throughout, unless specified otherwise.

Figure 1:
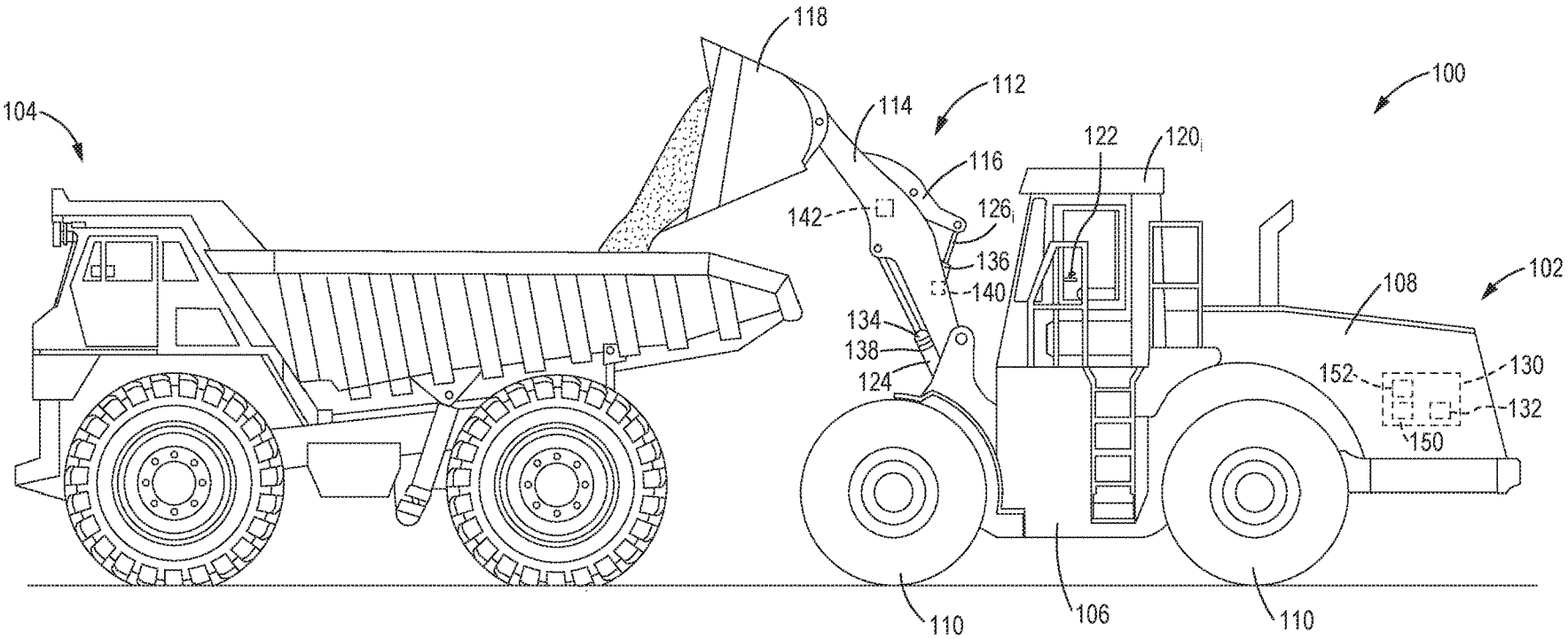
FIG. 1 is a diagrammatic side view of a wheeled loading machine with a payload detection system in accordance with an embodiment of the present disclosure.

Referring to FIG. 1, a representation of an exemplary worksite 100 according to one embodiment of the present disclosure is presented. A work machine 102 is deployed at the worksite 100 for performing a predetermined task. In an exemplary embodiment, the work machine 102 is a wheel loader, but, alternatively, the work machine 102 may include, but not limited to, a backhoe loader, a skid steer loader, a track type tractor, excavator, a load haul dump, and the like. It should be appreciated that the work machine 102 may include other industrial work machines 102 with similar loading implements such as, but not limited to, large mining trucks, articulated trucks, off-highway trucks, wheeled trucks, track-type trucks, and the like associated with mining, agriculture, forestry, construction, and other industrial applications. Moreover, the work machine 102 may be a manually operated machine, an autonomous machine, or a semi-autonomous machine which can be operated in both manual mode and autonomous mode. Therefore, it may be noted that embodiments disclosed herein can be similarly applied to various types of machines known in the art without deviating from the spirit of the present disclosure.

The work machine 102 may perform various operations at the worksite. In one example, the work machine 102 may perform a payload dump operation. More particularly, the work machine 102 may dump a payload into a haul machine or truck 104. The haul truck 104 may include machines, such as, a dump truck, a mining truck, or any other machine that is capable of holding and transporting the payload from one location to another on the worksite 100. Alternatively, the work machine 102 may dump the payload in a pile, a hopper, or other payload receiver at the worksite 100.

The work machine 102 may include a frame and/or chassis 106. The work machine 102 includes a powertrain or a drivetrain 108 for the production and transmission of motive power. The powertrain 108 may include an engine such as an internal combustion engine, a gas turbine, a hybrid engine, or the like. The powertrain 108 may include a motor connected to a power source like batteries, fuel cell, generator, or any other power source known in the art to power a motor. The powertrain 108 may further include a torque converter, geared transmission, electric motors, drive shafts, differentials, or other known drive links for transmission of motive power from the engine to ground engaging members 110. The ground engaging members 110, such as wheels or tracks, are mounted to the chassis 106 by a suspension system (not shown) which may include suspension springs, beams, hydraulic cylinders, axles, and the like for the purpose of mobility of the work machine 102 relative to the worksite terrain.

The work machine 102 includes a linkage assembly 112 attached to the frame 106. The linkage assembly 112 includes a linkage member 114 and a support arm 116. An implement 118, such as a bucket, may be pivotally coupled to the linkage member 114. The implement 118 of the linkage assembly 112 may be configured to collect, hold and convey any material and/or object at the worksite 100. It should be appreciated that the linkage assembly 112 and the implement 118 of the work machine 102 may vary based on the type of machine or the type of operation or task required to be carried out by the work machine 102.

An operator cabin 120 may be provided on the work machine 102 which houses the various operator input devices and controls of such as, but not limited to, joysticks, knobs, keyboards, a steering wheel, pedals, levers, buttons, switches, display devices, touchscreens, etc. that are adapted to operate the work machine 102. In an exemplary embodiment, the operator cabin 120 includes at least one touchscreen display device 122 configured to display a graphical user interface which can receive an operator touch input associated with displayed operator-selectable graphical elements.

During operation of the machine 102, the linkage member 114 and the implement 118 may be moved to different positions in order to perform dump operations. A hydraulic system or a pneumatic system (not shown) may be used to effectuate a movement of the linkage member 114, the support arm 116, and/or the implement 118 of the linkage assembly 112. For example, a lift cylinder 124 and a tilt cylinder 126 may effectuate and control the movement of the implement 118. The cylinders 124, 126 may embody any one of a hydraulic cylinder and a pneumatic cylinder. Based on the movement of the linkage member 114 and the implement 118, the work machine 102 may perform different operations such as loading, dumping, excavating, and the like.

The dump operation of the payload may require tipping of a desired amount of payload from the implement 118 into a haul truck, known as truck tip-off, or may require tipping off excess material from a payload onto a pile, known as pile tip-off. Tipping refers to the process of dumping a partial amount of material of the payload from the implement 118 based on operation requirements. For example, an operator of a wheeled loader with an 18 ton bucket capacity may be required to load a 45 ton capacity haul truck to maximum capacity. The goal of the loader operator is to load as much tonnage into the haul truck in the shortest amount of time while consuming the least amount of fuel of the loader in order to achieve peak efficiency and reduce operation costs. The operator must also load the haul truck within a payload tolerance without overloading the haul truck. It takes a considerable amount of skill for an operator to load haul trucks within the desired payload tolerances. To achieve the 45 ton capacity, the operator can dump two passes at the maximum capacity of the loader bucket to achieve 36 tons. In a final pass, the operator must only dump 9 tons to achieve the desired payload. Depending on the skill of the operator, the final pass can take anywhere from 3 to 5 times as long as the first two passes.

To reduce the duration of the final pass and reduce the overall time to achieve a target payload in a haul truck 104, the work machine 102 includes a payload detection system (PDS) 130. The PDS 130 includes a tip-off controller 132 and at least one sensor for generating an electronic signal associated with the material weight within in the implement 118 and an electronic signal associated with the angle of the implement 118. In one embodiment, the PDS 130 includes a lift pressure sensor 134 associated with the lift cylinder 124 and a tilt pressure sensor 136 associated with the tilt cylinder 126 to enable the detection of hydraulic fluid pressure within the respective cylinders 124, 126. The fluid pressure signals associated with the respective cylinders 124, 126 may be used, alone or in combination, to determine the weight of the material within the implement 118. The PDS 130 may include a lift displacement sensor 138 associated with the lift cylinder 124 and a tilt displacement sensor 140 associated with the tilt cylinder 126. The displacement signals associated with the respective cylinders 124, 126 can be used to determine the weight of the material within the implement 118. The PDS 130 may also include an inertial motion unit (IMU) 142 which can generate a signal indicative of a position, velocity, motion, and orientation of the linkage assembly 112 and/or the implement 118 which can be used to determine the weight of the material within the implement 118. It should be appreciated that the PDS 130 may include any of a number of measurement devices and sensors in accordance with the particular requirements of the particular worksite application not specifically described herein The tip-off controller 132 may include, or be coupled with as part of the PDS 130, at least one processing unit 150 which is configured to perform the functions of the tip-off controller 132. The processing unit 150 may embody a single microprocessor or multiple microprocessors that include components for receiving and monitoring the sensor signals of the PDS 130 of the work machine 102. For example, the processing unit 150 is configured to receive the fluid pressure signals from the lift and tilt pressure sensors 134, 136; the displacement signal from the lift and tilt displacement sensors 138, 140; and the position, velocity, motion, and orientation signals from the IMU 142. It should be appreciated that the processing unit 150 could readily be embodied in a general machine microprocessor capable of controlling numerous machine functions.

The tip-off controller 132 may further include, or be coupled with as part of the PDS 130, memory module 152 such as one or more data storage devices or another other component that may be used to run computer executable instructions that are stored to the memory module 152. It should be appreciated that various computer executable instructions, applications, computer program products, or other aspects that are generally described as stored to memory can also be stored on or read from various computer readable media such as, but not limited to, as computer chips and secondary storage devices, including hard disks, floppy disks, optical media, CD-ROM, or other forms of RAM or ROM.

The processing unit 150 may be configured with arithmetic units to algorithmically determine the weight of the material in the implement 118 based on any one of the sensor signals, alone or in combination, according to predetermined mathematical relationships which are stored in the memory module 152. The memory module 152 may store payload weight history data in order to determine, for example, a summed total weight of material loaded into the haul truck 104 during a loading procedure. The processing unit 150 also includes arithmetic units to algorithmically determine the angle of the implement 118 based on any one of the sensor signals, alone or in combination, according to predetermined mathematical relationships which are stored in the memory module 152.

As previously described, a loading procedure includes a final pass in which an operator performs a tip-off sequence to achieve a target payload weight. In one embodiment, the PDS 130 is configured to identify a final pass and automatically initiate a tip-off sequence as well as inform the operator via the user interface of the display device 122 that the tip-off sequence has been initiated. To identify a final pass of a loading sequence, the PDS 130 determines the material weight of each bucket load and calculates an accumulated payload weight by summing the weight of each individual bucket load and storing that data in the memory module 152. The accumulated payload weight is compared to a target payload weight to determine a remaining payload target. When the remaining payload target is less than the maximum capacity of the implement 118, the PDS 130 identifies that the next bucket load of material is a final pass payload and initiates an automated payload tip-off sequence. The PDS 130 informs the operator, via the user interface 122, that a tip-off sequence is initiated, of the remaining payload target, and instructs the operator to load material into the implement 118 in excess of the remaining target payload. Preferably, the operator will load at least 10% more material, by weight, than the remaining payload target. In another embodiment, the final pass is manually identified by the operator by selecting a corresponding graphical element displayed on the touchscreen display 122 to initiate the tip-off sequence.

INDUSTRIAL APPLICABILITY

In general, the PDS 130 and corresponding automated tipping sequence of the present disclosure can find applicability in in various industrial applications such as but not limited to work machines 102 such as those used throughout many industries, including but not limited to, earth moving, excavation, mining, agricultural, marine, construction, power generation, and other such industries. The PDS 130 achieves greater speed and accuracy during tip-off by staging the material to the angle of repose quickly and then exploiting the state of the staged material on the verge of spilling with incremental and controlled dumping and measuring to achieve the desired payload target.

Figure 2:
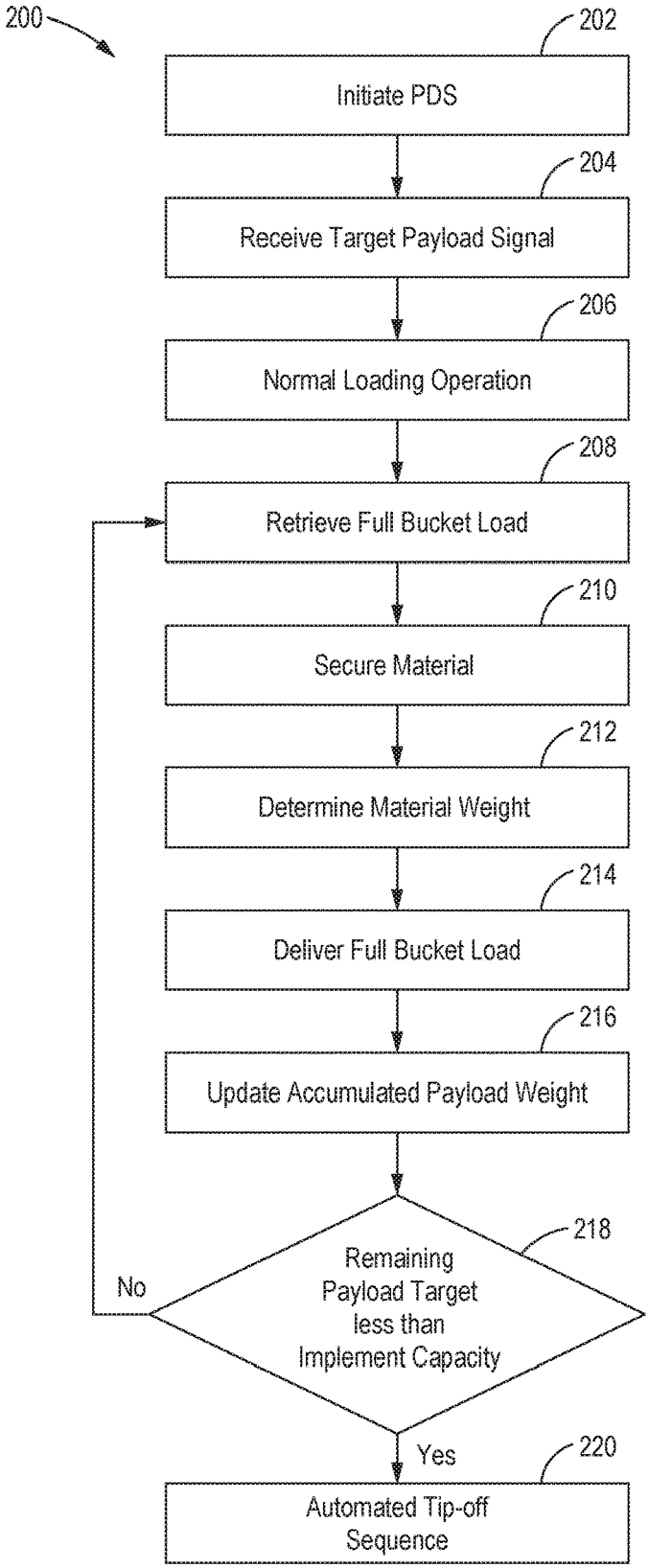
FIG. 2 is a flow chart of a loading sequence in accordance with an embodiment of the present disclosure.
Figure 3:
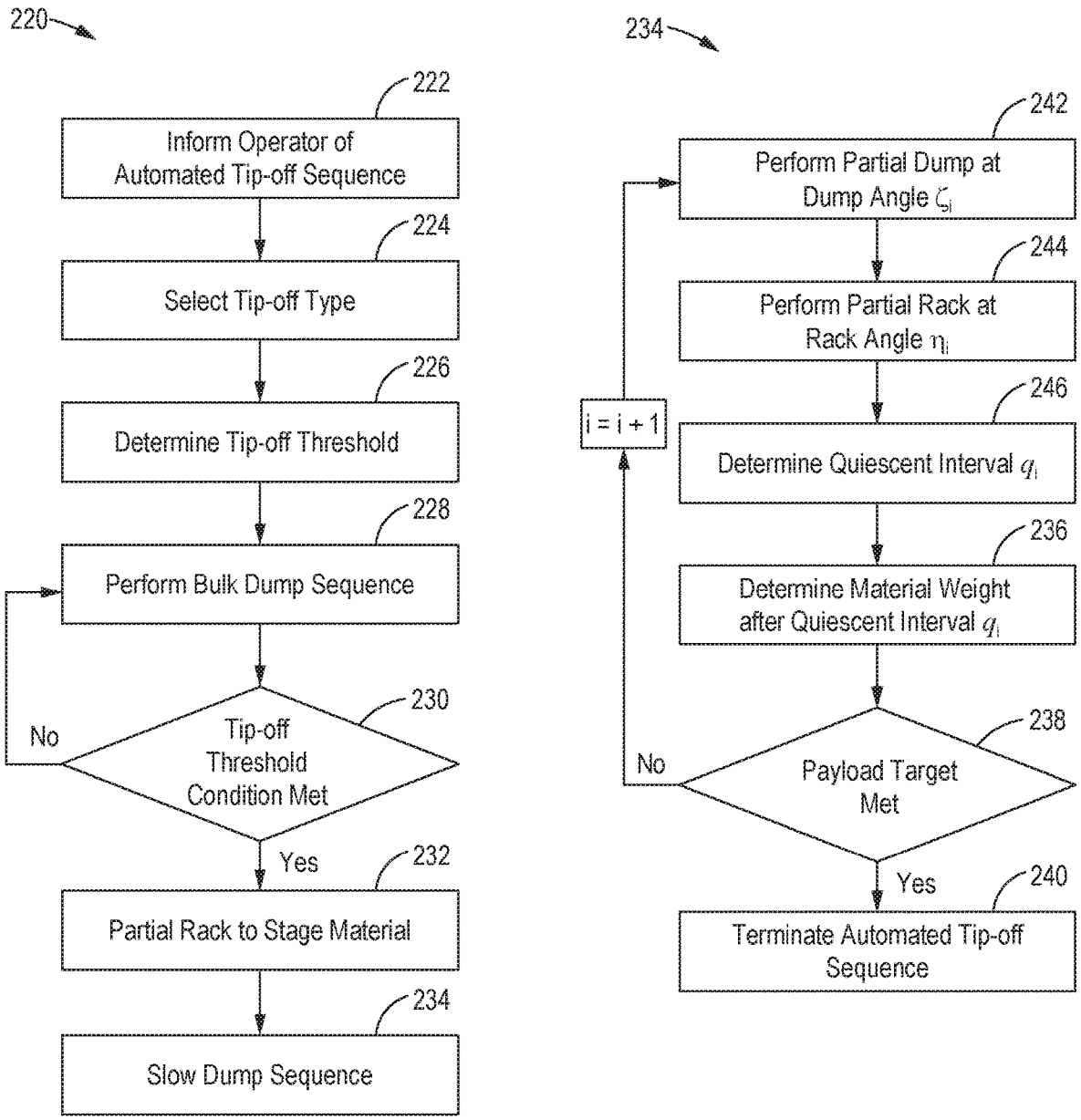
FIG. 3 is a is a flow chart of an automated tip-off sequence in accordance with an embodiment of the present disclosure.
Figure 4:
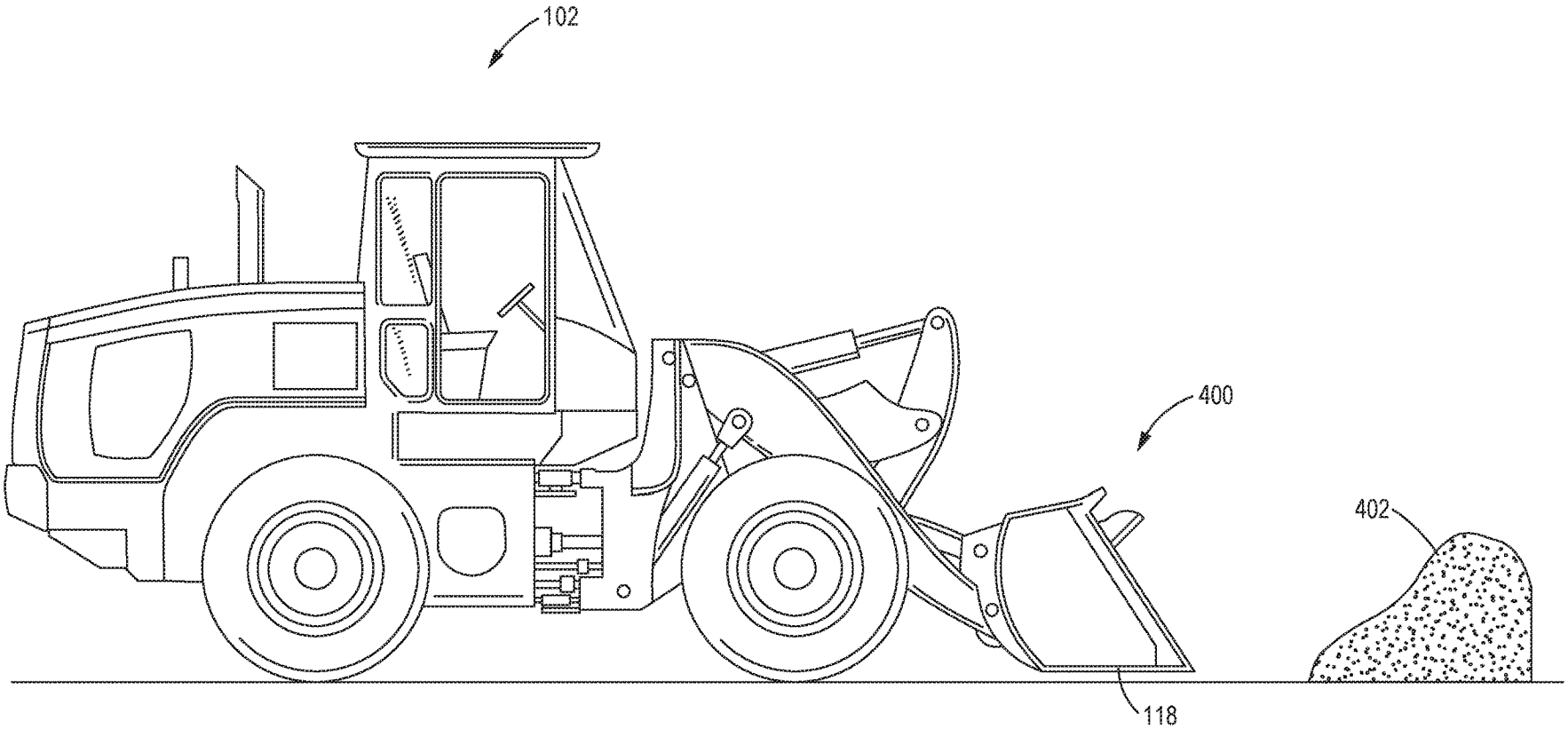
FIGS. 4-6 are diagrammatic side views of a wheeled loading machine having an implement angular position during a loading operation in accordance with an embodiment of the present disclosure.
Figure 5:
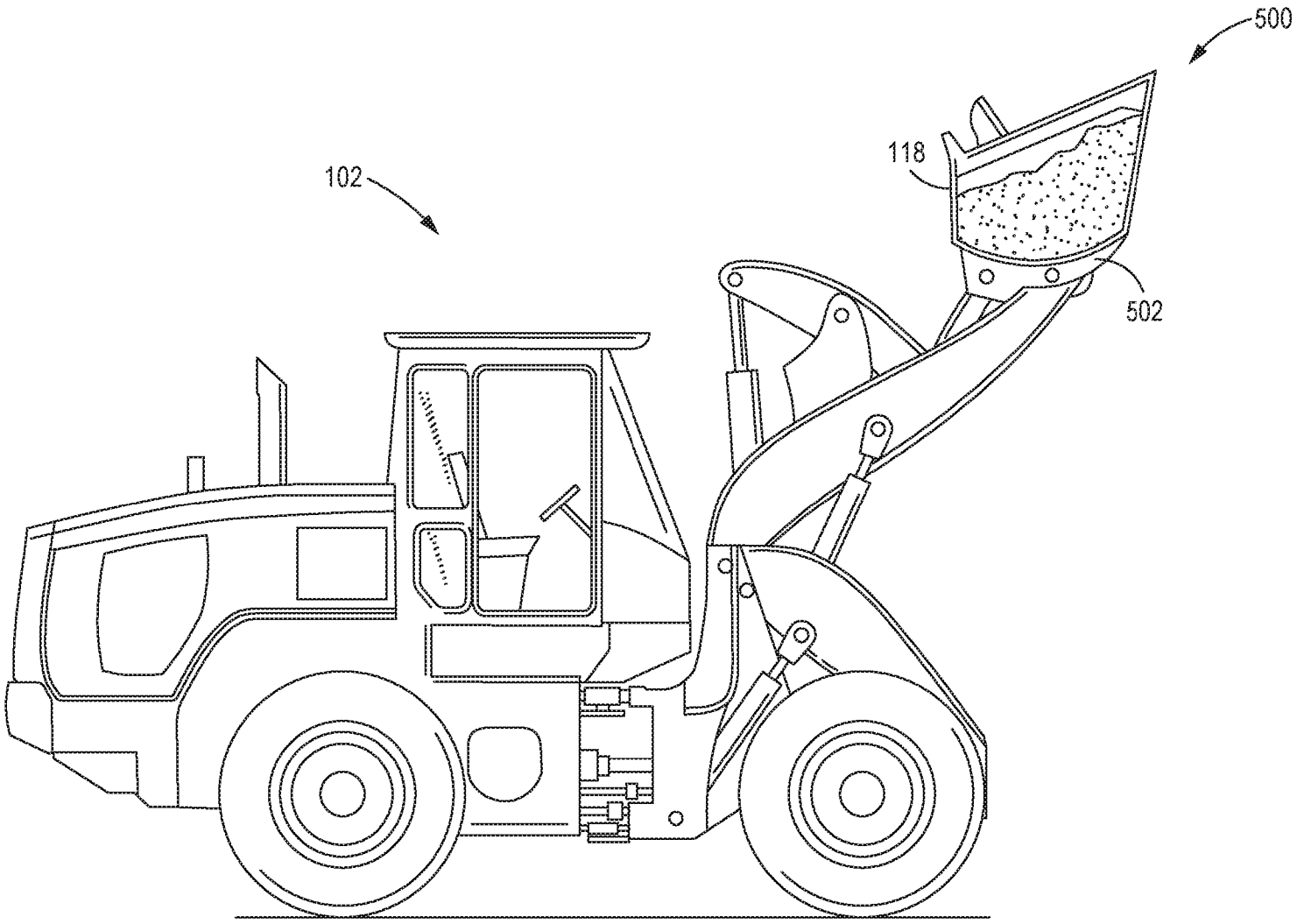
Figure 6:
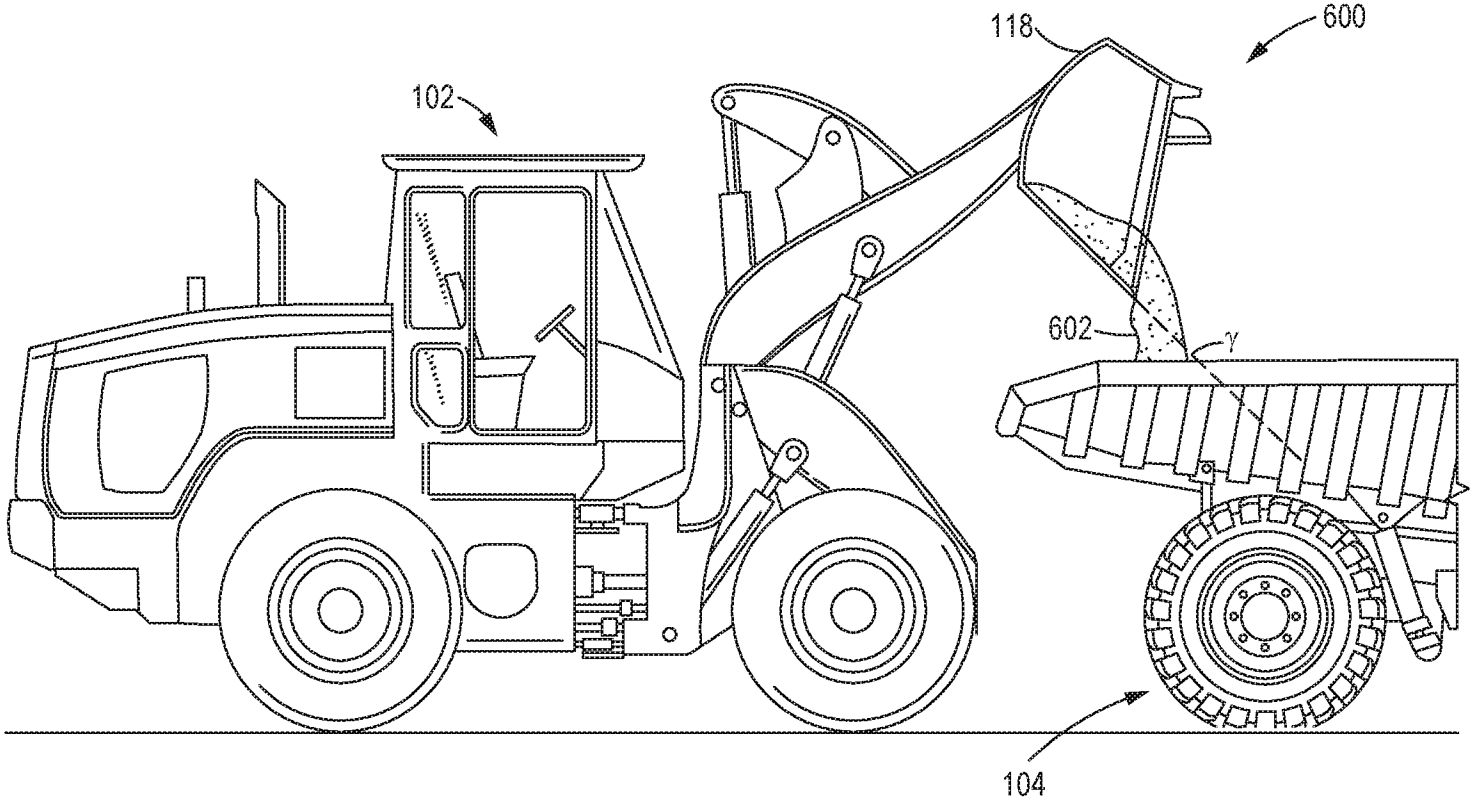
Figure 7:
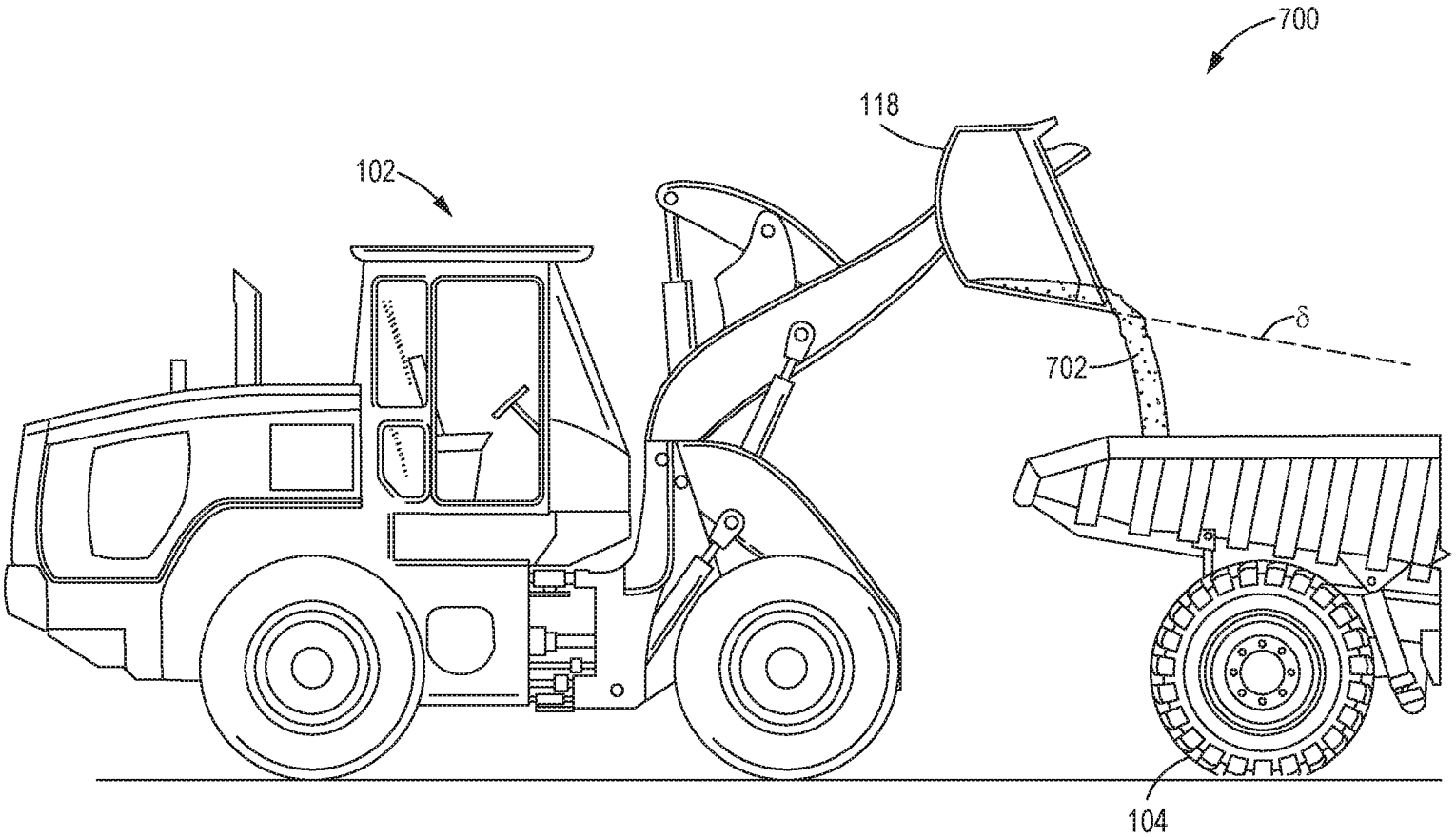
FIGS. 7-9 are diagrammatic side views of a wheeled loading machine having an implement angular position during an automated tip-off sequence in accordance with an embodiment of the present disclosure.
Figure 8:
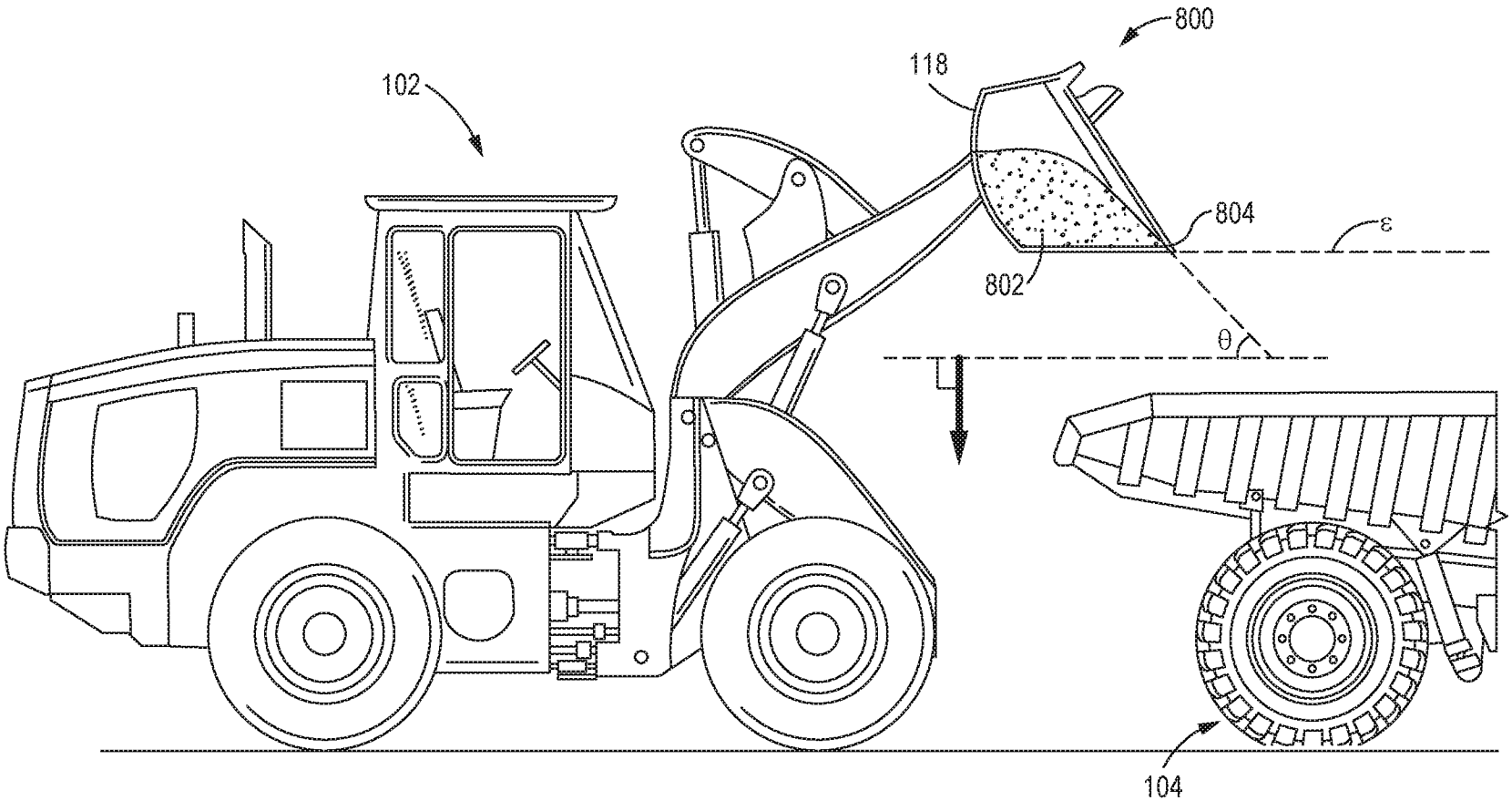
Figure 9:
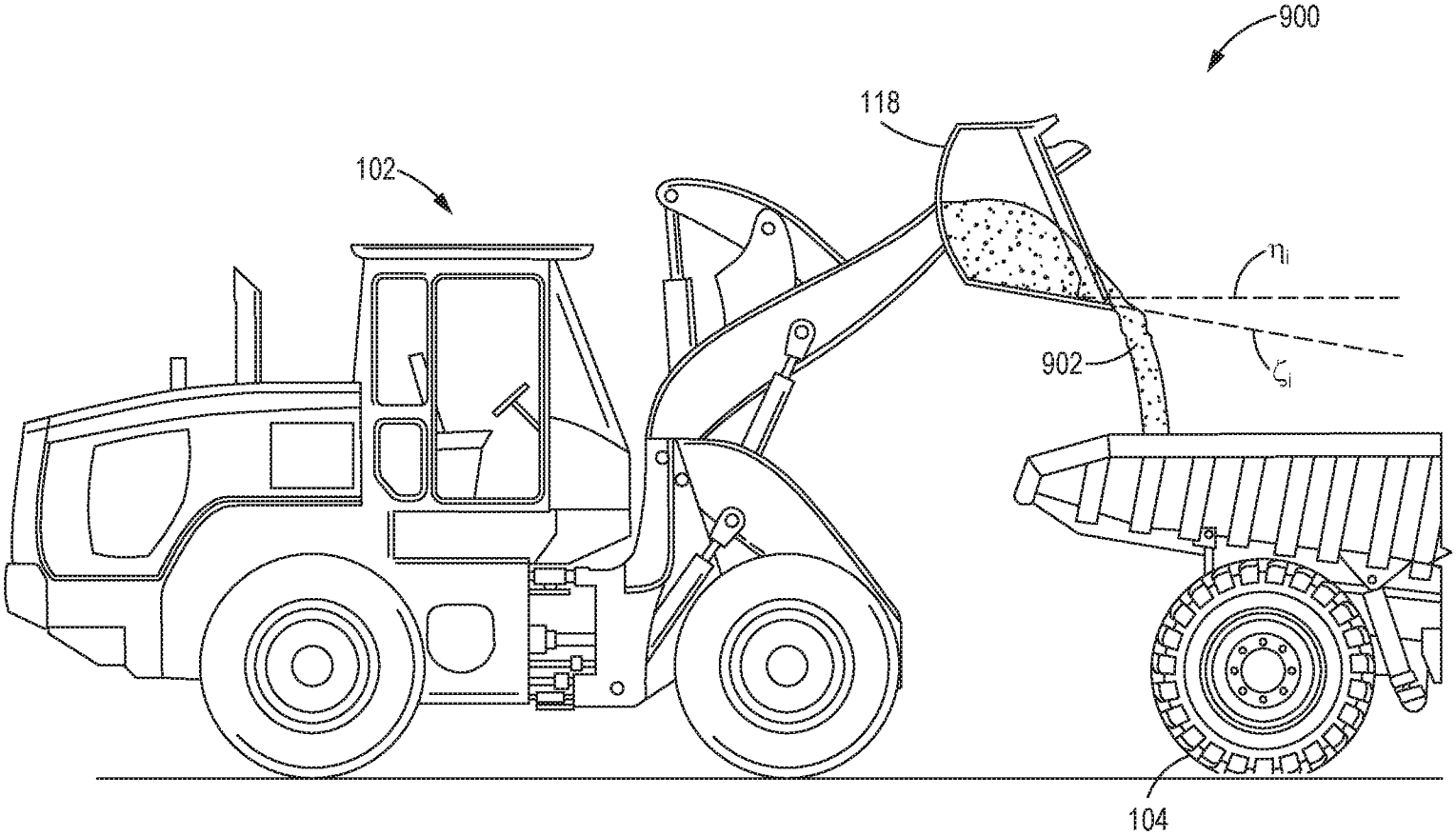

Referring to FIGS. 2 and 3, a flow chart of a loading sequence 200 and an automated tip-off sequence 300 is presented in the context of a final pass loading procedure which is illustrated in FIGS. 4-9 in which the work machine 102 is illustrated having the implement 118 in several angular positions $\alpha$, $\beta$, $\gamma$, $\delta$, $\varepsilon$, $\zeta_i$, and $\eta_i$, also known as implement angle or pitch angle. It should be appreciated that the pitch angle will be referred to as a loading angle, dump angle, or rack angle depending on the corresponding actuation and that the specified angles are not particularly associated with any part of the sequence. The first position 400, shown in FIG. 4, illustrates the implement 118 having a loading angle of $\alpha$, e.g. horizontal; the second position 500, shown in FIG. 5, is a fully racked position with the implement 118 having a rack angle of $\beta$; the third position 600, shown in FIG. 6, is a fully dump position with the implement 118 having a dump angle of $\gamma$; the fourth position 700, shown in FIG. 7, is a partial dump position 700 of the bulk dump sequence with the implement 118 having an dump angle of $\delta$; the fifth position 800, shown in FIG. 8, is a partial rack position between the bulk dump sequence and the slow dump sequence with the implement 118 having an rack angle of $\varepsilon$; the sixth position 900, shown in FIG. 9, is a partial spill position and a partial rack position during a slow dump sequence with implement 118 having a dump angle of $\zeta_i$ and a rack angle $\eta_i$.

At step 202, the operator initiates the PDS 130 by depressing a graphical element displayed to the operator via the touchscreen user interface 122. In step 204, the system 130 receives a signal associated with a desired target payload, e.g. the maximum capacity of the haul truck 104, either automatically from the haul truck 104 or manually from the operator. After the payload target weight is received, the operator is instructed to commence with a normal loading operation, step 206. As shown in FIG. 4, the operator will place the implement 118 into a loading position 400 with loading angle $\alpha$ to retrieve a full bucket load of material from pile 402, step 208. Once the material is retrieved, the operator will position the implement 118 to a fully racked position 500, with rack angle β as shown in FIG. 5, in order to secure the material 502 in the implement 118 for a material weight measurement, step 210.

Once the material 502 is secured and settled, the tip-off controller 132 will determine the material weight within the implement 118 based on a generated material weight signal received by the tip-off controller 132, step 212. The operator then positions the implement 118 over a receptacle of the haul truck 104 and positions the implement 118 in a dump position 600, with dump angle γ as shown in FIG. 6, to deliver the full bucked load of material to the haul truck 104, step 214. After the material is dumped, the tip-off controller 132 will update the accumulated payload weight according the weight determined in step 210, step 216, and determine the remaining payload target based a difference between target payload weight from step 202 and the accumulated payload weight, step 216. The operator repeats steps 206-216 until the remaining payload target is less than maximum capacity of the implement 118, step 218. When the remaining payload target is less than the maximum capacity of the 118, the tip-off controller 132 initiates the automated tipping sequence 220.

Continuing with FIG. 3, a flowchart of the automated tipping sequence 220 is illustrated. At step 222, the PDS 130 informs the operator, via the touch screen user interface 122, that a final pass condition is met, an automated tipping sequence 220 has been initiated, and instructs the operator to load the implement 118 of material from the pile 402 in excess of the remaining payload target. In another embodiment, the operator manually activates the PDS 130 via the graphical user interface 122 once the final pass determined by the operator themselves. The automated tipping sequence 220 has two dump sequences to ensure the payload in the haul truck 104 is optimized for its maximum capacity: a bulk dump sequence followed by a slow dump sequence. The bulk dump sequence is a single dump actuation in which the tip-off controller 132 controls the implement 118 to dump material till a tip-off threshold is reached and the material is staged for further dumping, at which point the tip-off controller 132 performs a partial rack to secure and maintain the staged material at the at a tip edge of the implement 118. The staged material is on the verge of falling from the bucket. This state is characterized by the slope of the material defining a line that originates from the edge of the bucket and having the steepest slope angle that the material can support relative to the horizontal, known as the angle of repose. By staging the material as described, the PDS 130 can perform the slow dump sequence with increased certainty of how the material will respond, resulting in higher precision that would be possible without the staging.

The slow dump sequence includes a series of small dump then rack actuations to slowly dump a controlled amount of material until the payload target is met or the remaining payload is less than the target. The slow dump sequence includes a plurality of high accuracy dump iterations of small dump then rack motions of the implement 118. This motion limits the amount of material that can be spilled in a single iteration and secures the payload before measuring the payload. It should be appreciated that the pitch angle after each iteration, whether it be part of the bulk dump sequence or the slow dump sequence, is progressively lower. In other words, after each dump then rack actuation, the implement 118 is tilted lower. This ensures that material will spill each iteration and that the material is properly staged at the tip edge.

Continuing with FIG. 3, at step 224, the operator selects whether the tip-off is occurring over the pile 402, i.e. pile tip-off, or over the haul truck 104, i.e. truck tip-off. This operator selects the type of tip-off via operator-selectable graphical elements displayed on the touchscreen the user interface 122. For example, as illustrated in FIGS. 7 and 8, a truck tip-off has been selected. However, it should be appreciated that tip-off controller 132 will perform the automated tip-off sequence 220 until either the target payload is achieved within haul truck 104 or until it is achieve based on the material remaining in the implement 118 itself. It should be appreciated that the operator can set the type of tip-off as a preference or default and not be presented with an option during each sequence.

Next, the tip-off controller 132 determines a tip-off threshold based on the material weight in the implement 118 and the remaining payload target signal, step 226. The tip-off threshold can also be determined based on the type of material to account for spill characteristics of the material. As stated above, the tip-off threshold is the condition to determine whether to switch from a bulk dump sequence to a slow dump sequence. Depending on the type of tip-off selected, e.g. truck or pile, the tip-threshold is determined based on the amount of material remaining within the implement or the accumulated payload weight, respectively. The tip-off controller 132 can determine the tip-off threshold dynamically or it can be based on a table of predetermined tip-off thresholds correlated with material type.

With reference to FIG. 7, at step 228, the tip-off controller 132 controls the implement 118 to perform a single dump actuation. The tip-off controller 132 positions the implement 118 to a partial dump position 700 at a dump angle δ in order to commence a bulk dump of material 702. During the bulk dump, the tip-off controller 132 continually receives the material weight signal to monitor the weight of the material in the implement 118 or update the accumulated payload weight in the haul truck 104. The tip-off controller 132 continues the bulk dump until the tip-off threshold is et or substantially met, step 230. If the accumulated payload is within the desired target payload, the sequence terminated. However, if the accumulated the payload is between the desired target payload and the tip-off threshold, then the tip-off Ile 132 controls the implement 118 to a partial rack position 800 by positioning the implement 118 to a rack angle of ε, as shown in FIG. 8, step 232. The partial rack actuation at the end of the bulk dump acts to stop the spill of material while also ensuring that material 802 maintains staged at the tip edge 804. The tip-off controller 132 determines this bucket angle, ε, by racking only a small angle from the preceding angle during the bulk dump. The bucket angle of ε is associated with the angle of repose e which characterizes the slope of the of the material 802 staged at the tip edge 804. By staging the materials at the tip edge 804, the tip-off controller 132 can make small, accurate dump-then-rack actuations to spill controlled amounts of material and then secure the material for an accurate measurement and increase the overall speed of the sequence.

At step 234, the tip-off controller 132 initiates the slow dump sequence. The slow dump sequence includes a plurality of dump then rack iterations, where each iteration includes a partial dump actuation, followed by a partial rack actuation, and a quiescent interval during with the tip-off controller 132 measures the material weight remaining in the implement 118. Since there is noise in the weight signal from linkage bounce 114, 116 and material settling in the implement 118, the quiescent interval allows the signal to approach steady state to achieve a more accurate reading. At step 236, before the slow dump sequence begins, the tip-off controller 132 determines whether the material weight in the implement 118 meets the payload target after a quiescent period $q_i$. At step 238, if the material weight meets the payload target, the slow dump sequence can be avoided and the automated tipping sequence 220 is terminated, step 240. If the material weight does not meet the payload target, then the slow dump sequence 234 is initiated. At step 242, the tip-off controller 132 controls the implement 118 to a dump angle $\zeta_i$ to initiate a partial dump; followed by a partial rack actuation with rack angle $\eta_i$, step 244; and then followed by a quiescent interval $q_i$, step 246. After the quiescent interval $q_i$; a material weight signal is generated from which the current the material weight in the implement 118 can be determined. It should be noted that after each successive iteration, i=1, 2, 3 . . . , n, the overall pitch angle (i.e. dump or rack angle) of the implement 118 becomes successively lower and more towards the fully dumped direction. For example, the pitch angle of the various actuations during slow dump sequence is as follows when the dump direction is considered to be in the negative direction from horizontal:

$$\zeta_1>\zeta_2>\zeta_3> \ldots >\zeta_n$$

$$\eta_1>\eta_2>\eta_3> \ldots >\eta_n$$

such that each successive actuation, whether it is a dump or rack actuation, has an overall pitch angle that will be successively lower.

In one embodiment, as the material in the implement becomes closer to the desired amount, the difference between successive angles may become smaller to reduce the material dumped in each iteration for accuracy reasons, as shown below:

$$(\zeta_1-\zeta_2)>(\zeta_2-\zeta_3)>(\zeta_3-\zeta_4)> \ldots >(\zeta_{n-1}-\zeta_n)$$

This is because as the amount of material decreases in the implement 118, the corresponding dump and rack angles $\zeta_i,\eta_i$ become progressively smaller. The amount of material in the implement 118 also effects generated weight signal. As the material weight in the implement decreases, the material weight signal may become more susceptible to noise from, for example, linkage bounce, material settling, and the like. To mitigate the increase in noise in the generated material weight signal; the tip-off controller 132 may increase the length of each successive quiescent interval, such that, $q_1<q_2< \ldots <q_n$. In order to determine the length of each quiescent interval $q_i$, the tip-off controller 132 may calculate a confidence metric based on an analysis of the noise in the material weight signal as well as previous material weight signals, previous quiescent intervals $q_{i-1}$, $q_{i-2}$, . . . $q_1$, or historical data related previous automated tipping sequences stored in memory module 152. It should be appreciated that the duration of the quiescent interval can be minimized based on the confidence metric such that subsequent quiescent interval may stay the same or may even be shorter in duration.

In the embodiment where the operator chooses a truck tip-off, the operator is then informed to deposit the remaining material in the implement 118 back to the pile 402. In the embodiment where the operator chooses a pile tip-off, the operator is then instructed to deposit the remaining material in the implement 118 into the receptacle of the haul truck 104.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein is merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

What is claimed is:

1. A method for automated payload tip-off for a worksite loading machine, the method including:

receiving a signal of a remaining payload target;

loading material into an implement in excess of the remaining payload target;

receiving a signal of a material weight within the implement and a signal of an angle of the implement;

determining a tip-off threshold based on the material weight and the remaining payload target; wherein a difference between the material weight and the remaining payload target greater than the tip-off threshold triggers a bulk dump sequence, and the difference below the tip-off threshold triggers a slow dump sequence;

the bulk dump sequence including a single implement actuation to induce material spill until the tip-off threshold is met and the material is staged; and the slow dump sequence including a plurality of dump then rack actuations to induce and then prevent material spill until the remaining payload target is met, each dump actuation having an associated dump angle and each successive dump angle is progressively smaller.

2. The method of claim 1, wherein each dump then rack actuation has an associated dump angle and rack angle, where the rack angle is less than the corresponding dump angle.

3. The method of claim 1, wherein the single implement actuation is followed by a partial rack actuation to secure and maintain the staged material at a tip edge of the implement.

4. The method of claim 1, wherein the material weight signal is generated continuously during the bulk dump sequence until the tip-off threshold is met.

5. The method of claim 1, wherein the material weight signal is generated between each dump then rack actuation of the slow dump sequence.

6. The method of claim 5, wherein the material weight signal is generated during a quiescent interval between each dump then rack actuation, such that a duration of the quiescent interval is minimized based on a confidence metric.

7. The method according to claim 6, wherein the confidence metric is based on noise in at least one of the material weight signal and the implement angle signal.

8. The method according to claim 1, wherein the material is staged at a tip edge of the implement on a verge of spilling having a slope corresponding to an angle of repose.

9. A payload detection system for automated payload tip-off of a loading operation, the system comprising:

a tip-off controller configured to:

receive a signal of a remaining payload target;

receive a signal of a material weight within an implement and a signal of an angle of the implement;

determine a tip-off threshold based on the material weight and the remaining payload target; wherein a difference between the material weight and the remaining payload target greater than the tip-off threshold triggers a bulk dump sequence, and the difference below the tip-off threshold triggers a slow dump sequence;

the bulk dump sequence including a single implement actuation to induce material spill until the tip-off threshold is met and the material is staged; and the slow dump sequence including a plurality of dump then rack actuations to induce and then prevent material spill until the remaining payload target is met, each dump actuation having an associated dump angle and each successive dump angle is progressively smaller.

10. The system according to claim 9, wherein each dump then rack actuation has an associated dump angle and rack angle, where the rack angle is less than the corresponding dump angle.

11. The system according to claim 9, wherein the single implement actuation is followed by a partial rack actuation to stage the material at a tip edge of the implement.

12. The system according to claim 9, wherein the material weight signal is generated continuously during the bulk dump sequence until the tip-off threshold is met.

13. The system according to claim 9, wherein the material weight signal is generated between each dump then rack actuation of the slow dump sequence.

14. The system according to claim 13, wherein the material weight signal is generated during a quiescent interval between each dump then rack actuation, such that a duration of the quiescent interval is minimized based on a confidence metric.

15. The system according to claim 14, wherein the confidence metric is based on noise in at least one of the material weight signal and the implement angle signal.

16. The system according to claim 15, wherein the material is staged at a tip edge of the implement on a verge of spilling having a slope corresponding to an angle of repose.

17. A haul machine comprising:

an implement configured to hold a payload therein;

a payload detection unit having at least one sensor for generating a signal of a material weight within the implement and at least one sensor for generating a signal of an angle of the implement;

a display unit for displaying a user interface including at least one of an operator-selectable graphical element configured to initiate an automated tip-off operation;

a tip-off controller configured to:

receive a signal of a remaining payload target;

receive from the payload detection unit a signal of a material weight within the implement and a signal of an angle of the implement;

determine a tip-off threshold based on the material weight and the remaining payload target; wherein a difference between the material weight and the remaining payload target greater than the tip-off threshold triggers a bulk dump sequence, and the difference below the tip-off threshold triggers a slow dump sequence;

the bulk dump sequence including a single implement actuation to induce material spill until the tip-off threshold is met and the material is staged; and the slow dump sequence including a plurality of dump then rack actuations to induce and then prevent material spill until the remaining payload target is met, each dump actuation having an associated dump angle and each successive dump angle is progressively smaller.

18. The haul machine of claim 17, wherein each dump then rack actuation has an associated dump angle and rack angle, where the rack angle is less than the corresponding dump angle such that subsequent dump then rack of the slow dump sequence lowers the overall pitch angle of the implement.

19. The haul machine of claim 17, wherein the material weight signal is generated during a quiescent interval between each dump then rack actuation, such that a duration of the quiescent interval is minimized based on a confidence metric.

20. The haul machine of claim 19, wherein the confidence metric is based on noise in at least one of the material weight signal and the implement angle signal.

* * * * *